US006098744A

United States Patent [19]

Kawamura

[11] Patent Number: 6,098,744

[45] Date of Patent: Aug. 8, 2000

[54] THERMAL-AND SOUND-INSULATING CONTAINER OF MULTILAYER INSULATIONS

[75] Inventor: Hideo Kawamura, Kanagawa, Japan

[73] Assignee: Isuzu Ceramics Research Institute Co., Ltd., Kanagawa-ken, Japan

[21] Appl. No.: 09/346,737

[22] Filed: Jul. 2, 1999

[30] Foreign Application Priority Data

Jul. 8, 1998 [JP] Japan ..... 10-193294
Sep. 3, 1998 [JP] Japan ..... 10-249628

[51] Int. Cl.[7] ..... A47B 81/06

[52] U.S. Cl. ..... 181/198; 181/200; 181/204; 181/284; 181/289; 181/290; 181/292; 62/169; 62/53.2; 62/296; 280/837; 280/838; 280/839; 220/592.01; 220/592.02; 220/592.03; 220/592.09; 220/592.27; 220/9.4

[58] Field of Search ..... 181/200, 204, 181/198, 289, 290, 292, 284; 62/169, 53.2, 296; 280/837, 838, 839; 220/592.01, 592.02, 592.03, 592.09, 592.2, 592.27, 9.4, 660, 668, 669, 673, 681

[56] References Cited

U.S. PATENT DOCUMENTS

| | | | |
|---|---|---|---|
| 2,412,146 | 12/1946 | Hansen | 280/5 |
| 3,034,309 | 5/1962 | Muck | 62/55 |
| 4,167,598 | 9/1979 | Logan et al. | 428/35 |
| 4,275,801 | 6/1981 | Bschorr | 181/290 |
| 4,513,041 | 4/1985 | Delluc | 428/69 |
| 4,759,000 | 7/1988 | Reitz | 367/176 |
| 4,780,159 | 10/1988 | Riel | 156/87 |
| 5,216,888 | 6/1993 | Kupiszewski et al. | 62/45.1 |
| 5,934,080 | 8/1999 | Foley et al. | 62/46.1 |
| 5,950,450 | 9/1999 | Meyer et al. | 62/457.9 |
| 5,954,101 | 9/1999 | Drube et al. | 141/82 |

FOREIGN PATENT DOCUMENTS 10-030453 2/1998 Japan .

*Primary Examiner*—Stanley J. Witkowski
*Assistant Examiner*—Edgardo San Martin
*Attorney, Agent, or Firm*—Browdy and Neimark, P.L.L.C.

[57] ABSTRACT

Disclosed a thermal- and sound-insulating container having a chamber, which is defined by multilayer wall structure including vacuum layers therein. The chamber is made as small as possible the surface area thereof to achieve the high insulating effectiveness. The thermal- and sound-insulating container is comprised of the multilayer wall structure with vacuum layers therein, which constitutes the chamber defined in a hollow cylinder partially having a flat secant face, the hollow cylinder having a cross section of a circle or an ellipse that closely resembles the circle. The multilayer wall structure is composed of a pair of confronting frames arranged spaced away from each other, surface panels attached to the frames to define an empty space between the confronting frames, and sealing members arranged between the frames and the peripheries of the surface panels so as to keep the space at vacuum. The thermal- and sound-insulating container may further include honeycomb cores arranged in the vacuum space, resin-made films enclosing hermetically the surface panels, and vacuum-failure indicators for detecting the rupture caused in the resin-made films of the surface panels.

17 Claims, 5 Drawing Sheets

THERMAL-AND SOUND-INSULATING CONTAINER OF MULTILAYER INSULATIONS

BACKGROUND OF THE INVENTION

1. Field of the Invention

The present invention relates to a thermal- and sound-insulating container of multilayer insulations, which is applicable to cold-storage freezers having thermal insulations, or soundproof containers having sound insulations, either stationary use or automotive use.

2. Description of the Prior Art

For most cogeneration system and automotive engines, diesel engines burning light oil are in general adopted and further electric generators are equipped. Modern diesel engines are easily recognized as a source of noise pollution. The major sources of the noise are high peak cylinder pressure, and large explosion load occurring in the combustion chambers. It is thus very hard to diminish noise caused by the diesel engines. Most engines such as cogeneration systems or hybrid engines have been customarily stationed in urban districts or highly populated areas or have traveled the urban community. Moreover, the cogeneration systems installed in buildings often causes a major problem of environmental pollution due to their noise, vibration or the like.

The use of refrigeration or cold-storage in commercial transportation of frozen foods or the like is widespread and popular, in which the vehicle frame is mounted with cold-storage freezer that is kept at below-atmospheric temperatures by the operation of refrigeration systems.

In the meantime, it is well known to those skilled in the art that double-wall structures with a vacuum layer between the confronting walls, for example, thermostatic cabinets, are preferable for heat- and sound-isolation because the transmission of heat and sound may be discontinued at the vacuum or decompressed layer between the walls of the double-wall structures.

As an alternative, the isolation of noisy sound emitted out of noise sources such as engines may be ensured by other wall structures of multiple layers, in which the walls through which sound waves might transmit are composed of solid, gas and solid that are overlaid one on another in order of mention, the walls are coated with heavy material such as lead, or the walls include vacuum layers each arranged between any adjoining solid layers.

The inventors have already developed a thermal- and sound-insulating container constructed of a double-wall structure with a vacuum layer between the confronting walls. Refer to, for example, Japanese Patent Laid-Open No. 30453/1998 and Japanese Patent Application No. 39868/1998.

For satisfactory isolation of noisy sound emitted out of the engines such as automotive engines, it is most advantageous to shield entirely the engine with any soundproof enclosure. Nevertheless, it is quite difficult to prepare by, for example, press-forming the engine enclosure designs that may shield efficiently the engine inclusive of accessories complicated in configuration, with making as small as possible clearances between the enclosure and the objects to be covered.

Under present conditions the prior cold-storage freezers have been constructed of the heat insulating members insufficient in thermal isolation, it is inevitable to make great in thickness the heat insulating members constituting the cold-storage freezer, resulting in disadvantages of becoming heavier in weight as well as actuating always refrigerating compressor large in rating.

SUMMARY OF THE INVENTION

The present invention has for its object to deal with the prior drawback described just above and in particular to provide a thermal- and sound-insulating container constructed of multilayer wall structures including vacuum layers therein, which has a chamber designed to be made less its surface area with respect to the volume available in the chamber. The thermal- and sound-insulating container is adapted to be use for a cold-storage freezer for storing cold-storage articles and frozen articles in the chamber defined by the multilayer wall structures, or automotive cold-storage freezer for transporting the articles. The thermal- and sound-insulating container may be moreover adapted for use of a soundproof enclosure to isolate noise sources such as engines installed in the chamber.

Another object of the present invention is to provide a thermal- and sound-insulating container wherein heat-insulating panels having vacuum layers therein are fixed to the walls of the cold-storage freezing compartment in an easily detachable manner, and the heat-insulating panels are each provided with warning means easily detecting a rupture of a resin-made films keeping the interspaces of the heat-insulating panels at the vacuum condition whereby the defective heat-insulating panels may be replaced with a new one when the vacuum-failure is detected.

The present invention is concerned with a thermal- and sound-insulating container comprising a multilayer wall structure forming a chamber defined in a circular hollow cylinder or a hollow cylinder partially having a flat secant face, the circular hollow cylinder having a cross section of a circle, ellipse and regular polygon that closely resemble the circle, and the multilayer wall structure being composed of a pair of confronting frames arranged spaced away from each other, surface panels attached to the frames to define a space between the confronting frames, and sealing members arranged between the frames and the peripheries of the surface panels so as to keep the space at vacuum.

According to one aspect of the present invention, a thermal- and sound-insulating container is disclosed wherein a vacuum pump is provided for evacuating the space to the vacuum.

According to another aspect of the present invention, a thermal- and sound-insulating container is disclosed wherein a pressure sensor is provided for monitoring the vacuum in the space and the vacuum pump operates in response to a pressure signal issued from the pressure sensor in accordance a monitored pressure above a preselected pressure in the space, thereby keeping the space at the vacuum.

According to another aspect of the present invention, a thermal- and sound-insulating container is closed wherein elastic bodies are arranged spaced from each other between the confronting frames to discontinue transmissions of sounds across the frames. Moreover, the elastic bodies are of rubber-made tubular members filled with air while the frames are formed with grooves into which are snugly fitted the sealing members.

According to another aspect of the present invention, a thermal- and sound-insulating container is disclosed wherein the surface panels each have an outwardly convex contour corresponding to a part of a sphere or a part of a cylinder in cross section.

According to a further another aspect of the present invention, a thermal- and sound-insulating container is disclosed, which is adapted to a stationary cold-storage freezer, an automotive cold-storage freezer mounted on a vehicle, or a sound-insulating container for containing a sound source of an engine.

In the thermal- and sound-insulating container of the double walls with the vacuum layers therein, any spherical, cylindrical or arched configuration of the container or the chamber results in rendering the container rich in resistance against deformation, which might be otherwise easily caused due to the atmospheric pressure, as well as small in the surface area thereof.

In accordance with the thermal- and sound-insulating container of the present invention, moreover, the multilayer wall structure is evacuated to the vacuum and the chamber constructed of the multilayer wall structure is designed to be made less its surface area with respect to the volume available in the chamber. This makes it possible to diminish the radiation of energy emitted out of the chameber to the atmosphere or the absorption of energy transferred into the chamber from the atmosphere across the multilayer insulations, resulting in providing the energy-saving cold-storage freezer. Especially, the thermal- and sound-insulating container of this invention, when having been mounted on the vehicle, may provide an automotive cold-storage freezer less in electric power consumption, and when having enclosed the noise source such as an engine, may provide a sound-insulating container superior in sound-isolation effectiveness.

Moreover, as the thermal- and sound-insulating container is constructed of the evacuated multilayer wall structure with vacuum spaces therein, the degree of thermal isolation may be increased so that the multilayer wall structure itself may be made less in thickness, resulting in providing the automotive cold-storage freezer that is light in weight with high insulating efficiency. The vacuum pump evacuates the space in the multilayer wall structure to assist isolating the cold atmosphere in the chamber from the ambient atmosphere whereby the refrigerating compressor is shortened in its operating duration with the result of less cost on running as well as less electric power consumption of the vehicle on which is mounted the freezer.

The thermal- and sound-insulating container constructed as described above is applicable to either of the stationary cold-storage freezer and the automotive cold-storage freezer mounted on the vehicle, which needs only the least electric power consumption, resulting in saving its running cost. The container may be also adapted to the sound-insulating enclosure to effectively isolate the noisy sound of the engines.

In the vehicle that mounts with the engine system including the turbocharger, the energy recovery means and the like for converting thermal energy in exhaust gases into electric energy, sufficient electric power may be ensured. In consequence, the vehicle with the engine system may keep most efficiently the thermal-insulating container the below-atmospheric temperature by making use of only the electric power regenerated in the engine system, with no aid of external power.

The present invention furthermore relates to a thermal- and sound-insulating container comprising walls defining a cold-storage freezing compartment, and heat-insulating panels arranged on surfaces of the walls, which face to the cold-storage freezing compartment, the heat-insulating panels being each composed of honeycomb cores to hold a vacuum layer, felts attached on both sides of the honeycomb cores, vacuum-failure indicator mixed in the felts and consisting of a powdery admixture of azolitmin and a substance that assumes alkalinity when reacting with water, and resin-made membranes overlaying on the felts, one on each felt, to hermetically enclose the vacuum layer, the resin-made membranes allowing to visually monitor change of color in the vacuum layer, and the resin-made membranes 36 having vents 38.

In another aspect of the present invention, a thermal- and sound-insulating container is disclosed, wherein the vacuum-failure indicator is applied on surfaces of the felts, which face the cold-storage freezing compartment, while caustic soda is selected for the vacuum-failure indicator that assumes alkaline by the reaction with water soaking through the felts. Moreover, the honeycomb cores may be made of porous plastics light in weight and the resin-made membranes may be of airtight films formed from any one selected from nylon, vinyl chloride and polyethylene.

In another aspect of the present invention, a thermal- and sound-insulating container is disclosed wherein the heat-insulating panels are fixed detachably to the walls. In addition, the heat-insulating panels are combined with the walls inside a door of the cold-storage freezer thereby providing inner doors, which may inhibit effectively the disappearance of cold atmosphere out of the cold-storage freezer or the heat transfer into the cold-storage freezer upon loading and unloading goods.

In another aspect of the present invention, a thermal- and sound-insulating container is disclosed wherein the felts shield around the honeycomb cores, exclusive of positions for the vents, the resin-made films enclose the entire outer peripheries of the felts, exclusive of positions for the vents, and plugs hermetically close the vents to maintain the vacuum layer of the honeycomb cores. As a result, the rupture of the resin-made membranes enclosing the entire of the honeycomb cores and the felts may be recognized immediately by the action of the vacuum-failure indicator.

In the thermal- and sound-insulating container as described just above, the adoption of the honeycomb cores and the felts results in less heat conduction to thereby keep the cold atmosphere in the cold-storage freezer and also the vacuum layer containing the honeycomb cores therein helps ensure the high degree of thermal isolation.

Moreover, according to the thermal- and sound-insulating container as described above, if any stored goods or unexpected stresses should damage the resin-made membrane shielding hermetically the honeycomb cores thereby breaking the vacuum in the space containing the honeycomb cores therein, resulting in lowering the heat-insulating effectiveness, water soaking into the felts through the rupture of the membranes reacts with the substance such as caustic soda in the vacuum-failure indicator, which thus assumes alkalinity thereby turning azolitmin blue, as a result of which the vacuum failure around the honeycomb cores may be recognized visually. Accordingly, when the vacuum-failure is detected, replacement of only the defective heat-insulating panels with a new one is sufficient to regenerate the wall structure thereby restoring immediately the high degree of thermal isolation in the cold-storage freezing compartment.

In the thermal- and sound-insulating container of the present invention, the heat-insulating panel is made an airtight structure and also the honeycomb cores themselves are of porous structure that allows a fluid to flow through them, so that the heat-insulating panels may be made vacuum insulations by simply evacuating the interiors of the panels to a low pressure.

Moreover, the resin-made membranes are made of transparent film of polyethylene, polyvinylidene chloride or the like so as to allow visually motoring change of color on the felts, which might happen inside the panel. This makes it possible to identify immediately the vacuum inside the multilayer wall or whether the vacuum is held inside the multilayer wall. Consequently, the defective panel alone may be replaced with a new one to ensure the vacuum inside the multilayer wall.

The vacuum layer in the multilayer panel helps ensure the high degree of thermal insulation in the thermal- and sound-insulating container and, in consequence, the refrigerating compressor may be made less in its required power. This is more advantageous in cost saving, compared with the operation of the vacuum pump to evacuate the multilayer insulations for enhancing the degree of thermal isolation.

The thermal- and sound-insulating container of this invention constructed as described above has the advantages, in which the reduced degree of thermal isolation is made immediately regenerated by replacing the defective heat-insulating panel with a new one, in w hich the vacuum layers of the honeycomb cores disconnect with high insulating effectiveness the cold-transfer from the cold-storage freezer to the external atmosphere or the heat-transfer from the external atmosphere to the cold-storage freezing compartment, and in which the stationary colds-storage freezer and automotive cold-storage freezer employing the container of this invention need only the least electric power consumption, resulting in saving its running cost.

Other objects and features of the present invention will be more apparent to those skilled in the art on consideration of the accompanying drawings and following specification wherein are disclosed preferred embodiments of the invention with the understanding that such variations, modifications and elimination of parts may be made therein as fall within the scope of the appended claims without departing from the spirit of the invention.

DETAILED DESCRIPTION OF THE PREFERRED EMBODIMENTS

Thermal- and sound-insulating containers constituted with multilayer insulations according to the present invention will be in detail explained below with reference to the accompanying drawings.

Figure 1:
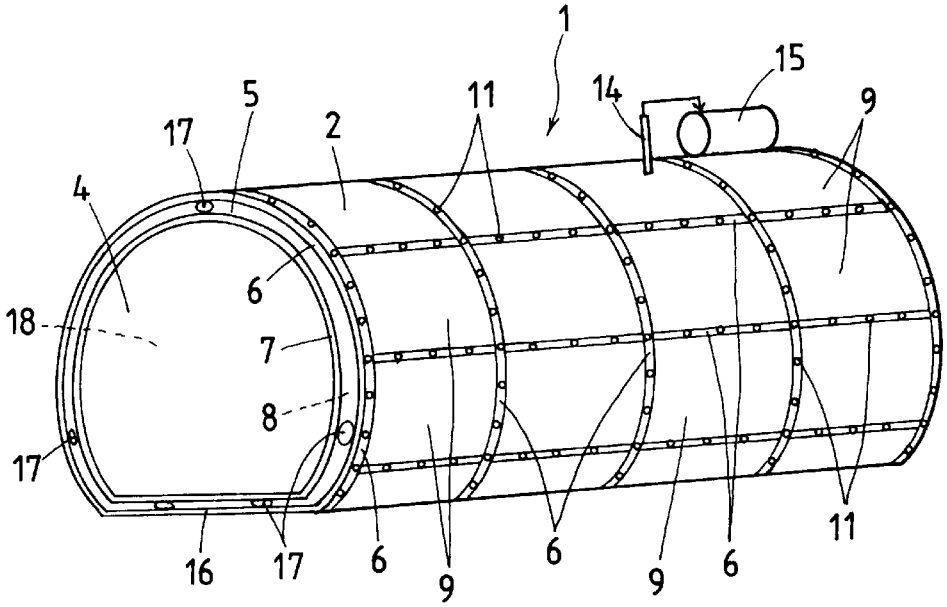
FIG. 1 is a schematic perspective view showing a preferred embodiment of a thermal- and sound-insulating container constituted with multilayer insulations according to the present invention.
Figure 2:
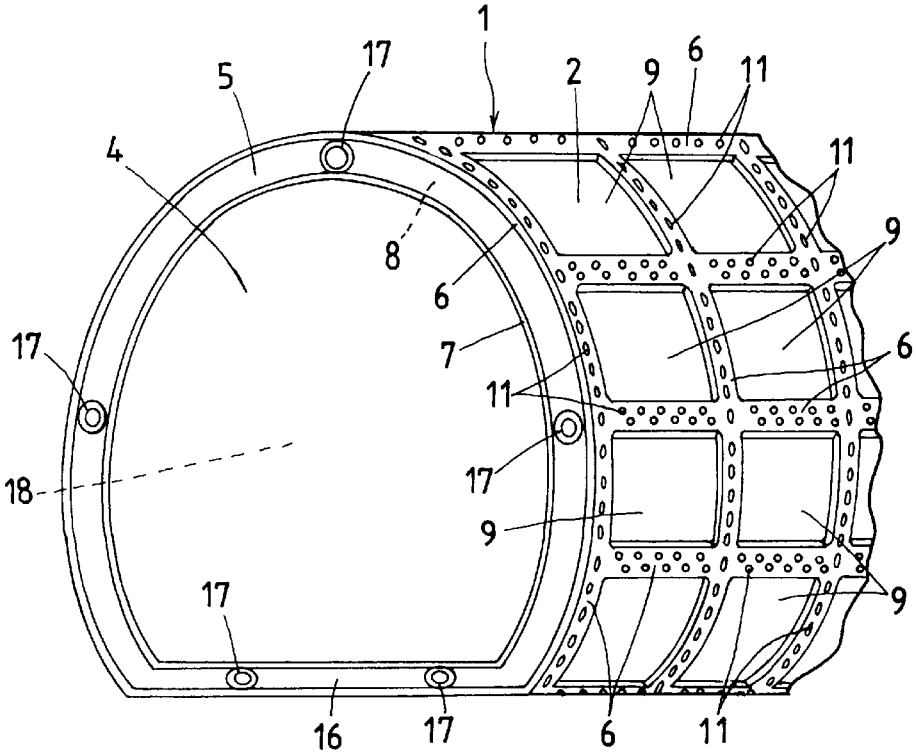
FIG. 2 is a fragmentary enlarged schematic perspective view of the thermal- and sound-insulating container constituted with multilayer insulations shown in FIG. 1.
Figure 3:
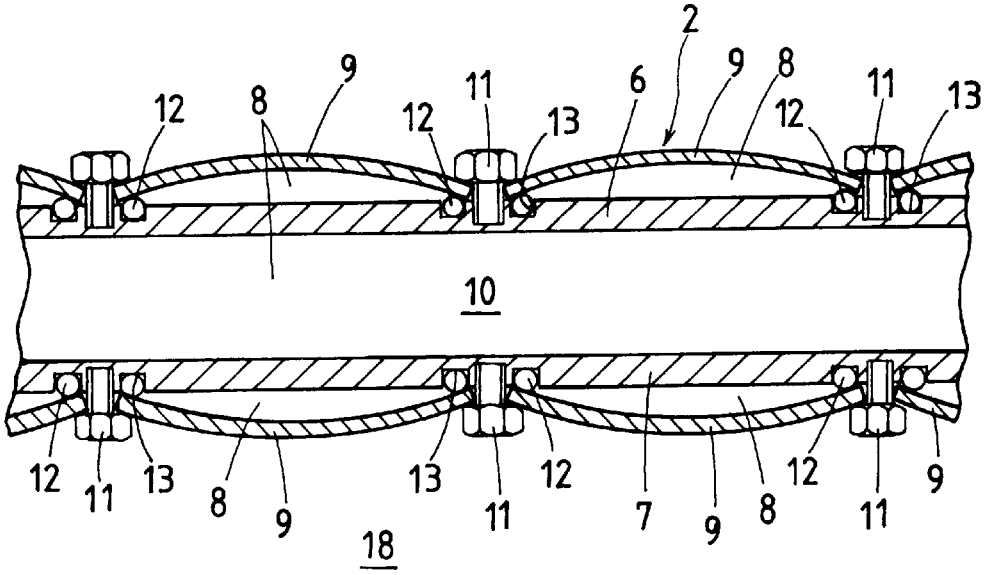
FIG. 3 is a fragmentary section showing a preferred embodiment of the multilayer insulations for the thermal- and sound-insulating container in FIG. 1.

First referring to FIGS. 1 to 3, a thermal- and sound-insulating container shown as a preferred embodiment of the present invention is constructed with a multilayer wall structure 2 formed into a hollow cylinder 1 having a cross section of a circle or an ellipse closely resembling the circle, which is partially made flattened at 16 to define a chamber 18. The multilayer wall structure 2 is hermetically sealed at axially opposing ends of the hollow cylinder 1 with end covers 5, while the chamber 18 is closed at axially ends thereof with lids 4. It will be noted that the chamber 18 of the contour as described above is rendered as small as possible in surface area thereof.

The multilayer wall structure 2 is composed of outer and inner frame members 6, 7 confronting spaced away from each other to provide a space 8 between them, surface panels 9 arranged overlaying on the outer and inner frame members 6, 7 to define spaces 8 between them and their associated frame member, and seal members 12 arranged along engaging areas of peripheries of the surface panels 9 with any associated frame member 6, 7. The surface panels 9 are bolted or riveted at 11 together with the associated frame members 6, 7.

The seal members 8 are of O-rings of hard rubber and the like, which are snugly fitted in grooves 13 in the inner and outer frame members 6, 7 thereby hermetically sealing the engaging areas of the surface panels 9 with the inner and outer frame members 6, 7 to keep the spaces 8 vacuum layers 10.

In the thermal- and sound-insulating containers constructed as described above, vacuum in the spaces 8 in the multilayer insulation 2 may be created by a vacuum pump 15 that draws air out of the spaces 8. A pressure sensor 14 monitors the vacuum in the spaces 8. The vacuum pump 15 starts to operate in response to a pressure signal reported from the pressure sensor 14 when the pressure in the spaces 8 is above a preselected pressure level, thereby taking in air in the spaces 8 till a desired reduced pressure is obtained in the spaces 8, resulting in keeping the vacuum layers 10 in the spaces 8 at an adequate vacuum.

According to the thermal- and sound-insulating container of the present invention, as apparent from the foregoing, the chamber 18 may be rendered as small as possible in its surface area and also the space 8 between the confronting inner and outer frame members 6, 7 is formed in the vacuum layer 10. This makes it possible to ensure the most efficient shutout of noise emission from the chamber 18 to the atmosphere as well as of heat transfer from the atmosphere to the interior of the chamber 18.

Arranged between the confronting inner and outer frame members 6, 7 are elastic members 17 at suitable intervals around the chamber 18 to isolate vibrations from each other and further help ensure a stability in structure for the multilayer wall structure 2. The elastic members 17 may be made of a tube of formed rubber, which is filled with air.

The panels 9, as shown in FIG. 3, each have an outwardly convex contour corresponding to a part of a sphere or an arced contour corresponding to a part of a cylinder in cross section. The panels 9 may be made of sheets of synthetic resins, aluminum and the like, which may be formed by pressing into a desired configuration. When regarding the sound-insulating property as important, a sponge rubber coating may be applied inside the panels 9 to attenuate the reflective sound wave in the vacuum layers 10 in the spaces 8.

The thermal- and sound-insulating container as described above may achieve the effective heat and sound isolation so that it may be adapted for a stationary cold-storage freezer or an automotive cold-storage freezer. The thermal- and sound-insulating container may be moreover adapted for a soundproof enclosure to isolate noise sources such as engines.

Next, another embodiment of the present invention will be explained with reference to FIG. 4. Compared with the first embodiment as described just above, this second embodiment is substantially identical with the first embodiment, with the exception of the cross-section of the hollow cylinder constructed of the multilayer wall structure. To that extent, like reference numerals designate identical or corresponding parts and the previous description is applicable.

Figure 4:
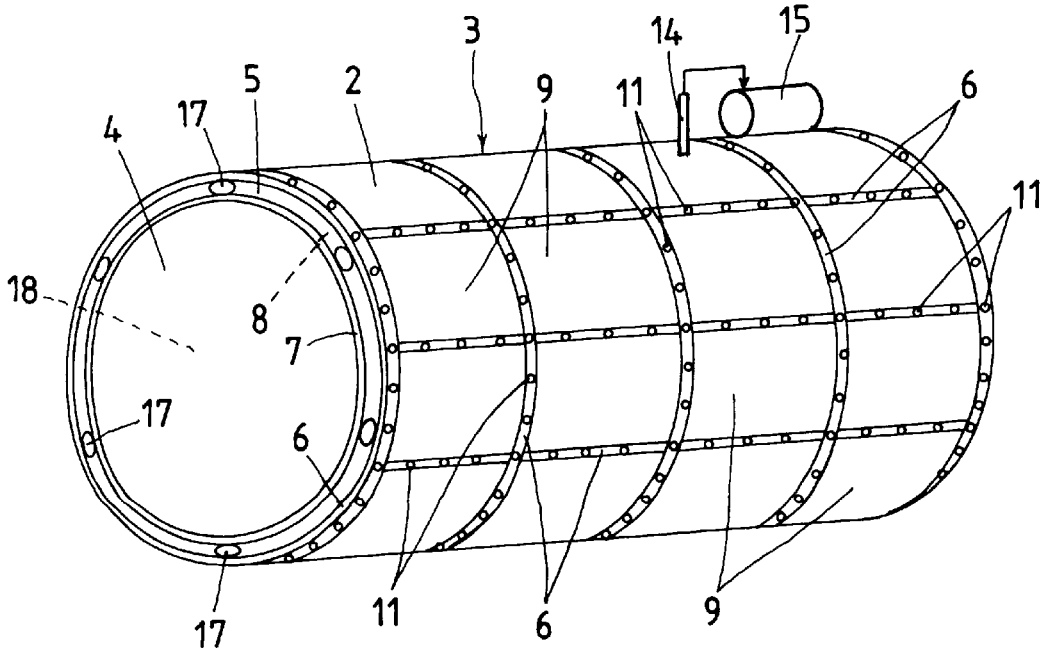
FIG. 4 is a schematic perspective view showing another embodiment of a thermal- and sound-insulating container constituted with multilayer insulations according to the present invention.

The thermal- and sound-insulating container shown in FIG. 4 is constructed of the multilayer wall structure 2 formed in a hollow cylinder 3 defining the chamber 18 having a cross-section of circle, or any of one of ellipse and polygon, which closely resembles the circle. Forming the chamber 18 in the cross-section resembling closely the circle results in making as small as possible the surface area of the chamber 18.

Figure 5:
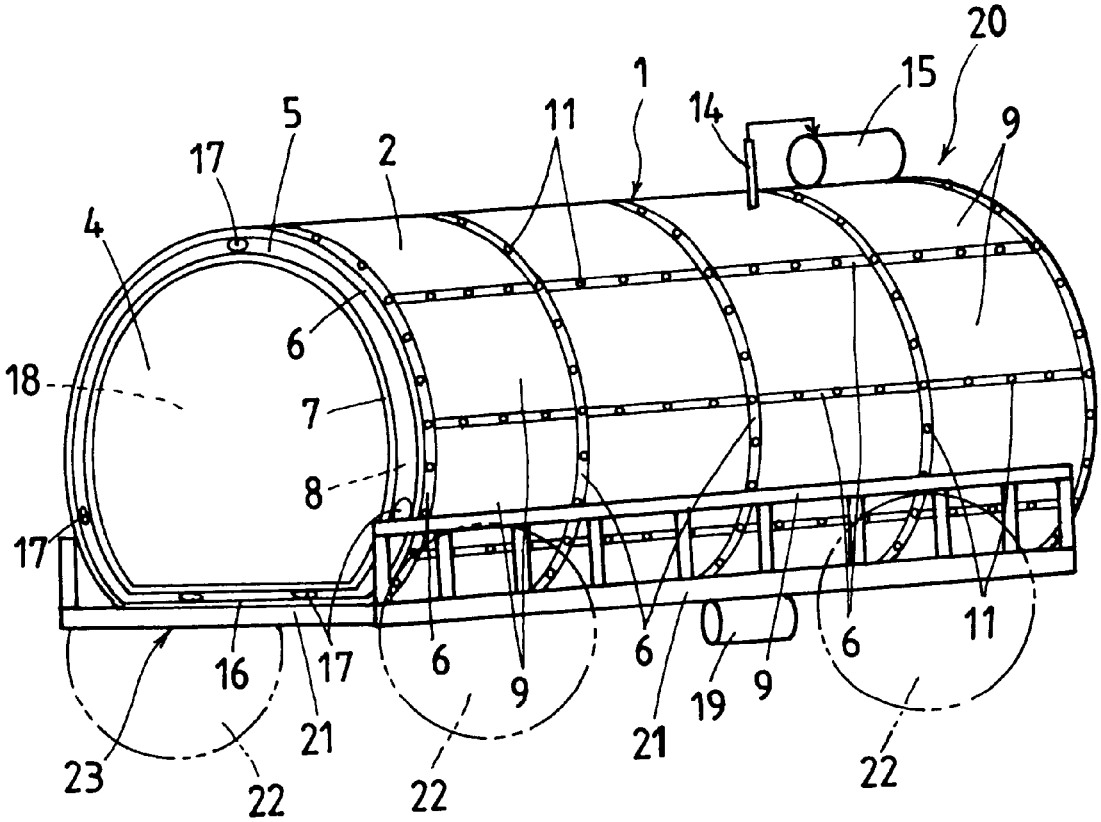
FIG. 5 is a schematic perspective view showing a further another embodiment of a thermal- and sound-insulating container constituted with multilayer insulations according to the present invention.
Figure 6:
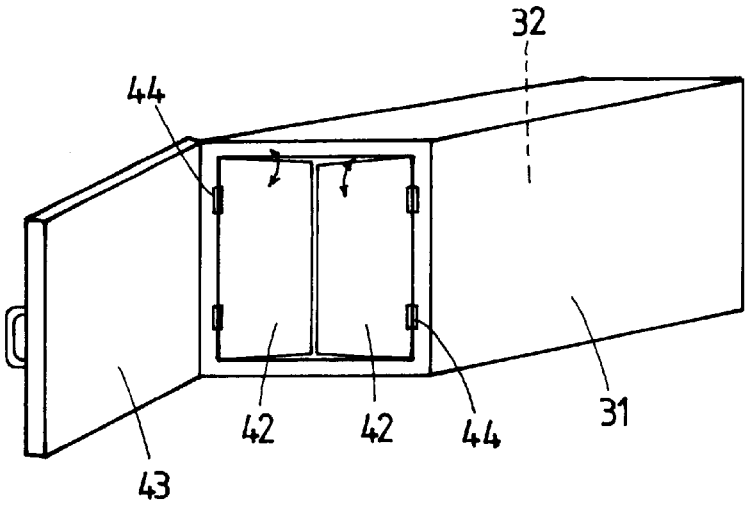
FIG. 6 is a schematic perspective view showing a preferred embodiment of a cold-storage freezer constituted with multilayer insulations according to the present invention.
Figure 7:
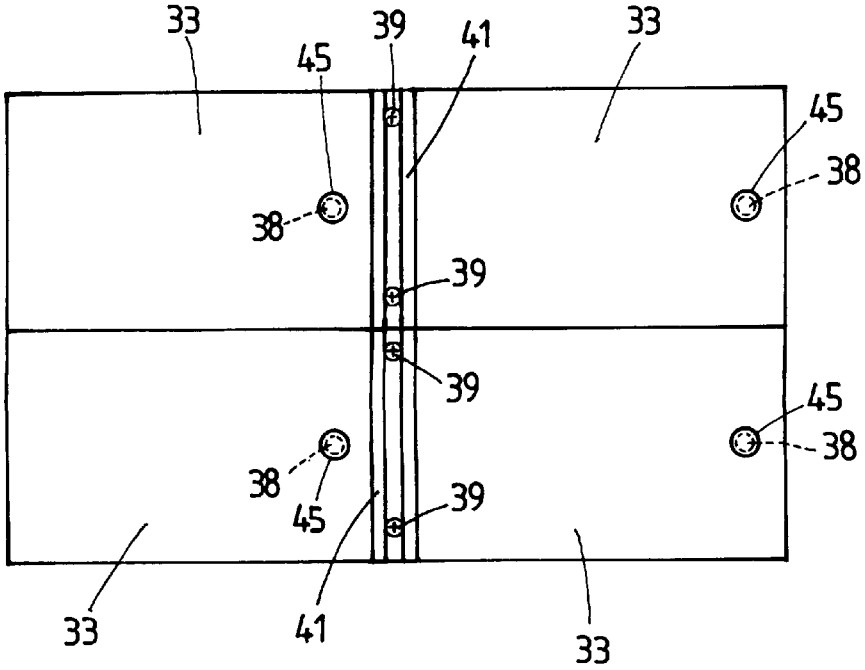
FIG. 7 is a schematic front elevation illustrating an interior of the cold-storage freezer of FIG. 6.
Figure 8:
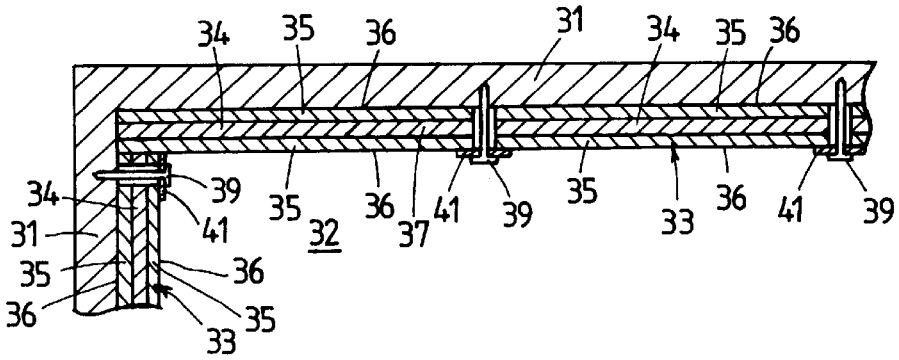
FIG. 8 is a fragmentary sectioned view showing a wall structure of the cold-storage freezer of FIG. 6.
Figure 9:
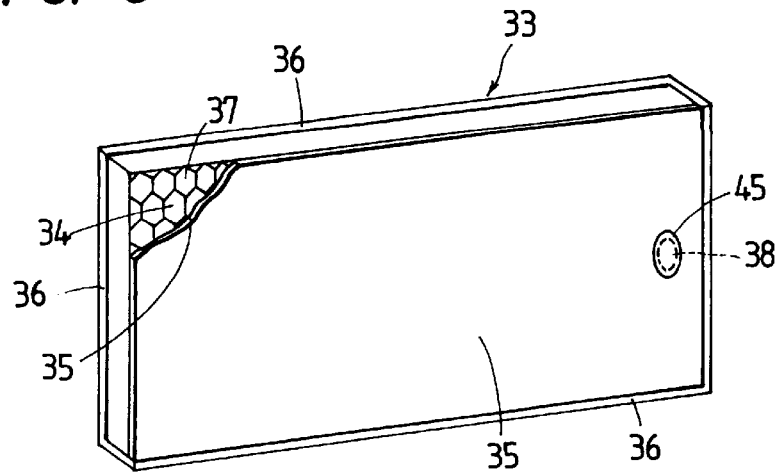
FIG. 9 is a schematic perspective view, partially broken away, showing a thermal-insulating panel incorporated in the cold-storage freezer shown in FIG. 6.
Figure 10:
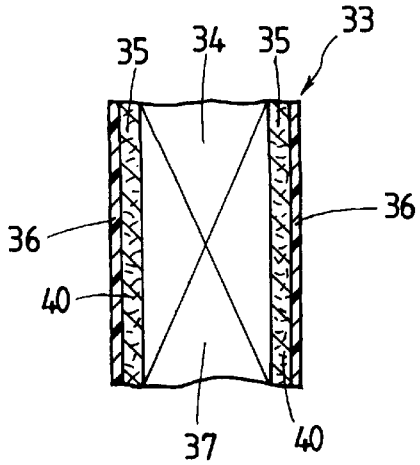
FIG. 10 is a fragmentary sectioned view showing the thermal-insulating panel incorporated in the cold-storage freezer shown in FIG. 6.

FIG. 5 shows a further another embodiment of the thermal- and sound-insulating container according to the present invention. This third embodiment is substantially identical with the preceding embodiments, except that any container described above is mounted on a vehicle. Therefore, like reference numerals designate parts or components identical in function and the previous description will be applicable.

Referring to FIG. 5, the thermal- and sound-insulating container is mounted on a frame 21 of a wagon 23 resting on land wheels 22 to provide an automotive cold-storage freezer 20. The wagon 23 has mounted with a refrigerating compressor 19, and further may mount with a system for converting thermal energy in exhaust gases expelled out of the engine into electric energy, which includes a turbocharger, energy recovery means, steam turbine, heat exchanger and the like. Electric power derived from the thermal energy in the exhaust gases emitted out of the engine is sufficient to drive the refrigerating compressor 19 mounted on the wagon 23 as well as the vacuum pump 15, thereby always keeping the thermal- and sound-insulating container at the optimum operating conditions.

Although not shown in the accompanying drawings, the chamber 18 defined by the multilayer wall structure may be formed in polygon, for example, regular octagon, decagon or the like, in cross-section, which closely resembles the circle. As having pointed out in the preceding description, forming the chamber 18 in the polygonal cross-section resembling the circle results in making as small as possible the surface area of the chamber 18.

The following will explains, with reference to FIGS. 6 to 10, the thermal- and sound-insulating container of the present invention embodied into cold-storage freezer.

The thermal- and sound-insulating container may be used for either of stationary cold-storage freezer at a preset position and an automotive cold-storage freezer mounted on a vehicle. The thermal- and sound-insulating container is composed of walls 31 defining a cold-storage freezing compartment 31, and heat-insulating panels 33 arranged inside the cold-storage freezing compartment 31.

The heat-insulating panels 33 are each comprised of honeycomb cores 34 to hold a vacuum layer 37, felts 35 attached on both sides of the honeycomb cores 34, vacuum-failure indicator 40 consisting of a powdery admixture of azolitmin and a substance that assumes alkalinity when reacting with water, which might permeate into the felts, and resin-made membranes 36 overlaying on the felts, one on each felt, to hermetically enclose the vacuum layer 37, the resin-made membranes 36 being of transparent or translucent so as to allow visually monitoring change of color, which might happen inside the panel, the resin-made membranes 36 having vents 38.

As an alternative, the vacuum-failure indicator 40 may be applied over any one surface of the felt 35, facing the cold-storage freezing compartment 32. Caustic soda may be selected for the vacuum-failure indicator 40 that assumes alkaline by the reaction with water soaking through the felts 35. Azolitmin contained in the vacuum-failure indicator is of a dark red color, and soluble in an aqueous solution of hydroxides of alkali metals and the like. Namely, azolitmin is a kind of acid-base indicator, or litmus paper, which reddens in a solution with pH less then 5, turns to blue with pH greater than 8, and remains unchanged in color with pH in the range of from 5 to 8. If water soaks into the felts 35 due to the unexpected rupture of the resin-made membranes 36, Caustic soda dissolves in the water, causing hydroxides of alkali metals whereby the vacuum-failure indicator 40 changes in color.

Moreover, the honeycomb cores are made of porous material that is formed from plastics light in weight. The resin-made membranes 36 are of airtight films formed from any one selected from nylon, vinyl chloride and polyethylene.

The heat-insulating panels 33 are detachably attached to the walls 31. In the embodiment shown, the heat-insulating panels 33 are screwed at 39 on the walls 32 along their adjoining edges through fixing member 41, which may be of adhesive tapes or the like for sealing clearances between the adjacent heat-insulating panels 33. As an alternative, adhesion may be used for fixing the heat-insulating panels 33 on the walls 31. The cold-storage freezer may be provided with inner doors 42 that are hinged at 44 to the walls 31 inside the door 42 for opening and closing motions. Thus, the inner doors 42 may confine the freezing atmosphere in the cold-storage freezing compartment 32 still after the door 43 has been opened.

In the thermal- and sound container described above, the vacuum layer 37 composed of honeycomb cores 34 wrapped with the resin-made membranes 36 provides the superior heat isolation. In order to produce vacuum in the space containing the honeycomb cores 34, a vacuum pump takes in air through the vents 38 in the resin-made membranes 36, which are thereafter plugged at 45. A vacuum in the vacuum layer 37 containing the honeycomb cores 34 therein is monitored, for example, by a pressure sensor to keep the vacuum layer at a desired vacuum. The desirable vacuum in the vacuum layer 37 including the honeycomb cores 34 helps ensure the most efficient heat isolation inside the cold-storage freezing compartment 32, namely, discontinue effectively the heat transfer from atmosphere into the compartment 32.

In the vehicle that mounts with the engine system including the turbocharger, the energy recovery means and the like for converting thermal energy in exhaust gases into electric energy, sufficient electric power may be ensured to energize the refrigerator keeping the cold-storage freezer at the below-atmospheric temperature as well as to operate the vacuum pump creating vacuum in the space containing the honeycomb cores therein. In consequence, the vehicle with the engine system may keep most efficiently the thermal-insulating container below the atmospheric temperature by making use of only the electric power regenerated in the engine system, with no aid of external power.

While the present invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A thermal- and sound-insulating container comprising a multilayer wall structure forming a chamber defined in any one form of a circular hollow cylinder and a hollow cylinder partially having a flat secant face, the circular hollow cylinder having a cross section of any one selected from a circle, ellipse and regular polygon that closely resemble the circle, and the multilayer wall structure being composed of a pair of confronting frames arranged spaced away from each other, surface panels attached to the frames to define a space between the confronting frames, and sealing members arranged between the frames and the peripheries of the surface panels so as to keep the space at vacuum.

2. A thermal- and sound-insulating container constructed as defined in claim 1, wherein a vacuum pump is provided for evacuating the space to the vacuum.

3. A thermal- and sound-insulating container constructed as defined in claim 2, wherein a pressure sensor is provided for monitoring the vacuum in the space and the vacuum pump operates in response to a pressure signal issued from the pressure sensor in accordance a monitored pressure above a preselected pressure in the space, thereby keeping the space at the vacuum.

4. A thermal- and sound-insulating container constructed as defined in claim 1, wherein elastic bodies are arranged spaced from each other between the confronting frames to discontinue transmissions of sounds across the frames.

5. A thermal- and sound-insulating container constructed as defined in claim 4, wherein the elastic bodies are of rubber-made tubular members filled with air.

6. A thermal- and sound-insulating container constructed as defined in claim 1, wherein the frames are formed with grooves into which are snugly fitted the sealing members.

7. A thermal- and sound-insulating container constructed as defined in claim 1, wherein the surface panels each have an outwardly convex contour corresponding to any one of a part of a sphere and a part of a cylinder in cross section.

8. A thermal- and sound-insulating container constructed as defined in claim 1, which is adapted to any one of a stationary cold-storage freezer, an automotive cold-storage freezer mounted on a vehicle, and a sound-insulating container for containing a sound source of an engine.

9. A thermal- and sound-insulating container comprising walls defining a cold-storage freezing compartment, and heat-insulating panels arranged on surfaces of the walls, which face to the cold-storage freezing compartment, the heat-insulating panels being each composed of honeycomb cores to hold a vacuum layer, felts attached on both sides of the honeycomb cores, vacuum-failure indicator mixed in the felts and consisting of a powdery admixture of azolitmin and a substance that assumes alkalinity when reacting with water, and resin-made membranes overlaying on the felts, one on each felt, to hermetically enclose the vacuum layer, the resin-made membranes allowing to visually monitor change of color in the vacuum layer, and the resin-made membranes having vents.

10. A thermal- and sound-insulating container constructed as defined in claim 9, wherein the vacuum-failure indicator is applied on surfaces of the felts, which face the cold-storage freezing compartment.

11. A thermal- and sound-insulating container constructed as defined in claim 9, wherein caustic soda is selected for the vacuum-failure indicator that assumes alkaline by the reaction with water soaking through the felts.

12. A thermal- and sound-insulating container constructed as defined in claim 9, wherein the honeycomb cores are made of porous plastics light in weight.

13. A thermal- and sound-insulating container constructed as defined in claim 9, wherein the resin-made membranes are of airtight films formed from any one selected from nylon, vinyl chloride and polyethylene.

14. A thermal- and sound-insulating container constructed as defined in claim 9, wherein the heat-insulating panels are fixed detachably to the walls.

15. A thermal- and sound-insulating container constructed as defined in claim 9, wherein the heat-insulating panels are combined with the walls inside a door of the cold-storage freezer thereby providing inner doors.

16. A thermal- and sound-insulating container constructed as defined in claim 9, wherein the felts shield around the honeycomb cores, exclusive of positions for the vents, the resin-made films enclose the entire outer peripheries of the felts, exclusive of positions for the vents, and plugs hermetically close the vents to maintain the vacuum layer of the honeycomb cores.

17. A thermal- and sound-insulating container constructed as defined in claim 9, which is adapted to any one of a stationary cold-storage freezer and an automotive cold-storage freezer mounted on a vehicle.

* * * * *